US005540605A

United States Patent [19]

Lin

[11] Patent Number: 5,540,605

[45] Date of Patent: Jul. 30, 1996

[54] WATER INLET FOIL GRATING OF MOTORBOAT

[76] Inventor: Solas Y. J. Lin, 37, 35th Road Taichung Industrial Park, Taichung, Taiwan

[21] Appl. No.: 275,400

[22] Filed: Jul. 15, 1994

[51] Int. Cl.[6] ..... B63H 11/01

[52] U.S. Cl. ..... 440/46; 440/47

[58] Field of Search ..... 440/46, 47, 38

[56] References Cited

U.S. PATENT DOCUMENTS

| | | | |
|---|---|---|---|
| 3,757,728 | 9/1973 | Rhoda | 60/35.5 X |
| 4,237,812 | 12/1980 | Richardson | 440/38 |
| 4,775,341 | 10/1988 | Tyler et al. | 440/38 |
| 5,114,368 | 5/1992 | Moyle | 440/47 |
| 5,234,361 | 8/1993 | Dickinson | 440/47 |

*Primary Examiner*—Sherman Basinger
*Attorney, Agent, or Firm*—Browdy and Neimark

[57] ABSTRACT

A motorboat water inlet foil grating comprises a frame and a pair of wing pieces. The frame is fastened to the water inlet located at the bottom of a motorboat hull. The wing pieces are mounted obliquely on the frame such that the lower segments of the wing pieces face forward and that the upper segments of the wing pieces face rearward. Each of the wing pieces has a concave upper surface and a convex lower surface. The concave upper surface faces upwards while the convex lower surface faces downwards. The frame is provided with a reinforcing portion for bracing the wing pieces which are capable of guiding water to flow evenly in the water channel of the motorboat so as to enable the propeller of the motorboat to compress the water current efficiently to enhance the forward power of the motorboat.

4 Claims, 3 Drawing Sheets

WATER INLET FOIL GRATING OF MOTORBOAT

FIELD OF THE INVENTION

The present invention relates generally to a motorboat, and more particularly to a water inlet foil grating mounted in the water inlet which is located at the bottom of the motorboat for guiding the water current so as to promote the sailing speed and the sailing controllability of the motorboat.

BACKGROUND OF THE INVENTION

As shown in FIG. 1, a conventional motorboat 10 comprises a hull 11, an engine 12 mounted securely inside the hull 11, a water channel 13 which runs through the interior of the hull 11 to reach the rear end of the hull 11 from a water inlet 14 located at the bottom of the hull 11, a transmission shaft 15 having a front end capable of being driven by the engine 12 and having a rear end which extends to reach the inside of the channel 13, and a propeller 16 fastened to the rear end of the transmission shaft 15. The water is allowed to enter the water channel 13 via the water inlet 14. The water in the water channel 13 is acted on by the rotating propeller 16 driven by the engine 12 such that the water is forced out rapidly from the rear end of the water channel 13 to bring about a reaction force, which impels the motorboat 10 forward.

The water inlet 14 is generally provided with a guiding device 20 intended to prevent the water current in the water channel 13 from becoming turbulent. The turbulent water current in the water channel 13 can undermine the speed and the controllability of the motorboat 10.

The U.S. Pat. No. 3,757,728 discloses a guiding device of a platelike construction, which is provided with forked upper end extending into the water channel, and with a lower end extending to reach beyond the underside of the motorboat. Such a guiding device as described above is defective in design in that the forked upper end of the guiding device can cause easily the turbulent water currents, and that the speed of the motorboat is undermined by a resistance induced by the water current against the lower end of the guiding device, and further that the lower end of the guiding device is vulnerable to deformation caused by the impact of the water current, and still further that the lower end of the guiding device is a potential safety hazard to a motorboat operator or rider, as well as a swimmer.

The U.S. Pat. No. 4,237,812 discloses a frame-shaped grating, which is provided in the inner edge of the rear end portion thereof with a slope. Such a prior art grating as described above is rather ineffective in guiding the water current into the water channel of the motorboat and is not helpful in promoting the cruising speed of the motorboat.

The U.S. Pat. No. 5,114,368 discloses a water inlet grating comprising a vertical fixation plate which is provided respectively on both sides thereof with a guide piece extending outwards and horizontally. This prior art grating is defective in design in that the guide piece is susceptible to deformation caused by the impact of the water current in view of the fact that only side of the guide piece is fastened to the vertical fixation plate. In addition, the vertical fixation plate interferes the flow of the water current to bring about a turbulence at the time when the motorboat moves forward. Furthermore, the lower end of the fixation plate extends beyond the bottom of the motorboat and is therefore a potential safety hazard.

Such shortcomings of the prior art gratings as described above are overcome by a water inlet grating, which is disclosed in the U.S. Pat. No. 5,234,361. Nevertheless this water inlet grating has several deficiencies, which are described explicitly hereinafter.

The water inlet grating disclosed in the U.S. Pat. No. 5,234,361 is rather ineffective in guiding the water current to flow toward the portion over the water channel in view of the fact that the water inlet grating has only one guide piece which is obliquely disposed and is provided with the water current guiding surface having a recessed lower segment and a protruded upper segment. The guiding surface has an S-shaped side elevational view. As a result, when the water current passes the upper segment of the guiding surface, a forward pressure is brought about against the guide piece to undermine the forward momentum of the motorboat. Moreover, a motorboat is bound to move up and down in an undulating water. Such an up-and-down motion of the motorboat can cause a substantial reduction in the amount of water going into the water channel of the motorboat and can therefore cause a substantial amount of air to be sucked into the water channel of the motorboat to bring about the idling of the motorboat propeller.

SUMMARY OF THE INVENTION

It is therefore the primary objective of the present invention to provide a motorboat water inlet foil grating capable of guiding the water current in a stable manner that the speed and the controllability of the motorboat are effectively enhanced.

It is another objective of the present invention to provide a motorboat water inlet foil grating capable of causing the motorboat to move stably in an undulating water.

It is still another objective of the present invention to provide a motorboat water inlet foil grating which can be made integrally.

In keeping with the principle of the present invention, the foregoing, objectives of the present invention are attained by a motorboat water inlet foil grating, which comprises a frame having two parallel ribs and a pair of wing pieces. The frame is fastened to the water inlet located at the bottom of a motorboat. The wing pieces are mounted obliquely on the two parallel ribs of the frame such that the lower segments of the wing pieces face forward and that the upper segments of the wing pieces face rearward. Each of the two wing pieces has a concave upper surface and a width which extends transverse to the longitudinal length of the parallel ribs of the frame and a convex lower surface. The concave upper surface of the wing pieces faces upwards while the convex lower surface of the wing pieces faces downwards. The frame is provided with a reinforcing portion for bracing the wing pieces which are capable of guiding the water to flow evenly in the water channel of the motorboat so as to enable the propeller of the motorboat to compress the water current efficiently to enhance the forward power of the motorboat.

DETAILED DESCRIPTION OF THE INVENTION

Figure 1:
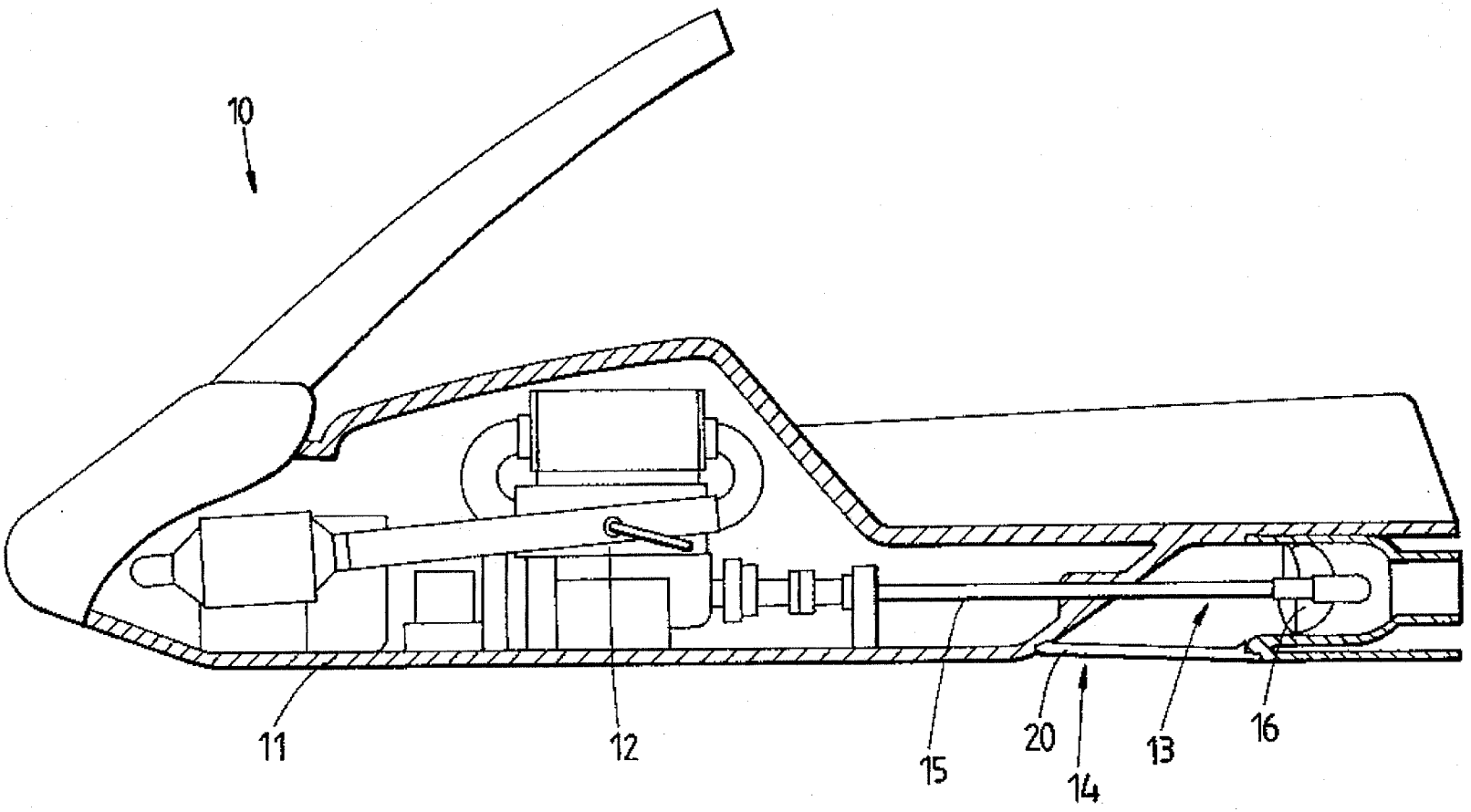
FIG. 1 (PRIOR ART)
FIG. 1 shows a longitudinal sectional view of a motorboat of the prior art.
Figure 2:
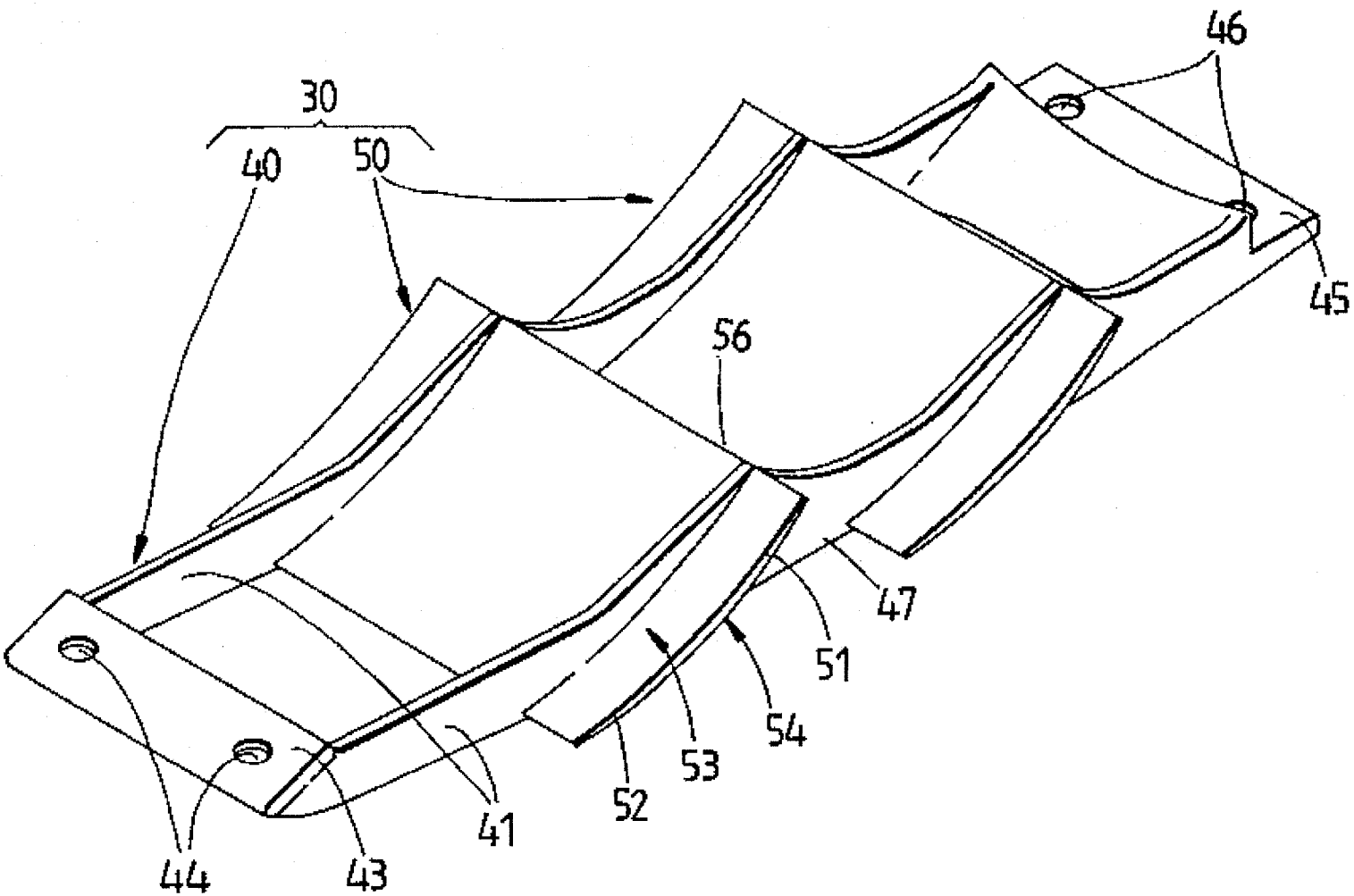
FIG. 2 shows a perspective view of the present invention.
Figure 3:
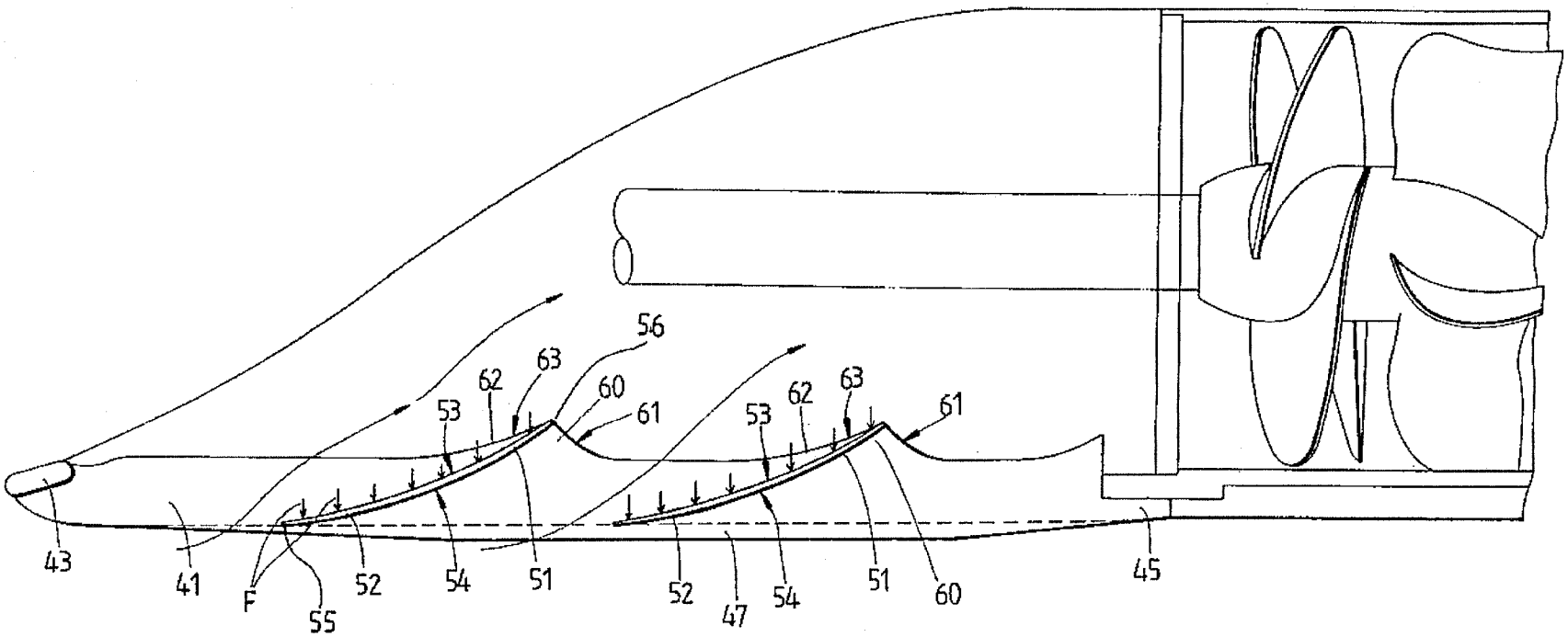
FIG. 3 shows a longitudinal sectional view of the present invention.

As shown in FIGS. 2 and 3, a motorboat water inlet foil grating 30 of the present invention is integrally made up of a frame 40 and a pair of wing pieces 50.

The frame 40 has a pair of ribs parallel to each other, a first connection portion 43, and a second connection portion 45. The first and the second connection portions 43 and 45 are connected respectively with the portions between the front and the rear ends of the two ribs 41. The first and the second connection portions 43 and 45 are provided respectively with through holes 44 and 46, which are engageable with screws (not shown in the drawings) for fastening the first and the second connection portions 43 and 45 to the motorboat water inlet.

Each of the two wing pieces 50 has a lower section 52, which is bridged between the ribs 41, and an upper section 51 facing upwards and rearwards to extend obliquely to reach over the rib 41. The motorboat water inlet is therefore divided into three water entry areas. Each of the two wing pieces 50 is wider than the frame 40. The width of the two wing pieces 50 extends transversely to the longitudinal length of the two ribs 41.

As the motorboat moves forward, the water going into the water channel of the motorboat is guided by the two wing pieces 50 such that the water current flows evenly in the water channel so as to enable the propeller of the motorboat to compress the water current efficiently to enhance the forward speed of the motorboat.

Each of the two wing pieces 50 has a concave upper surface 53 and a convex lower surface 54. Each surface extends from leading edge 55 to trailing edge 56. The convex lower surface 54 is longer than the concave upper surface 53. As the water current flows through the concave upper surface 53 and the convex lower surface 54, the concave upper surface is exerted on by a downward pressure F brought about by the water current. The downward pressure F serves to stabilize the tail end of the motorboat when the motorboat moves forward in an undulating water. As a result, the motorboat is less likely to be caused to move up and down by the undulating water waves, thereby minimizing the likelihood that a large amount of air is sucked into the water channel of the motorboat to cause the propeller of the motorboat to idle.

Each of the ribs 41 is provided on the bottom edge thereof with an arcuate projection 47 extending along the axis of the rib 41 such that the arcuate projection 47 faces downwards. Each of the wing pieces 50 has a bottom which is coplanar with the bottom of the motorboat hull, as shown by a dotted line in FIG. 3. The arcuate projection 47 is so extended slightly beyond the bottom of the motorboat hull as to protect the wing piece 50 in the event that the motorboat hits a snag or that the motorboat runs aground.

Each of the wing pieces 50 is provided with a first reinforcing portion 60 located between the convex lower surface 54 and the upper edge of the rib 41. The first reinforcing portion 60 has a thickness equal to the thickness of the rib 41 and a concave upper surface 61. The back of the wing piece 50 is so braced by the first reinforcing portion 60 that the upper section 51 of the wing piece 50 is immune from deformation caused by the impact of the water current. In addition, the first reinforcing portion 60 serves to eliminate a blind spot formed between the convex lower surface 54 of the wing piece 50 and the upper edge of the rib 41, so as to facilitate the removal of the formed grating 30 from the molding tool, which is not shown in the drawing.

A second reinforcing portion 62 is formed between the concave upper surface 53 of the upper section 51 of the wing piece 50 and the upper edge of the rib 41. The second reinforcing portion 62 has a thickness equal to the thickness of the rib 41 which is corresponding in location to the second reinforcing portion 62. In addition, the second reinforcing portion 62 has a concave upper surface 63 extending downward, forward and obliquely from the top edge of the upper section 51. The second reinforcing portion 62 serves to enhance the resistance of the upper section 51 against the impact of the water current. In addition, the second reinforcing portion 62 works together with the first reinforcing portion 60 to enhance the flexural rigidity of the rib 41.

What is claimed is:

1. An integrally-made motorboat water inlet foil grating comprising:

a frame consisting of two parallel ribs, a first connection portion and a second connection portion, with said first connection portion and said second connection portion being connected respectively between a front end and a rear end of said two parallel ribs; and two wing pieces, each said wing pieces having a width extending transversely to the longitudinal length of said two parallel ribs, each of said wing pieces having a lower section bridged between said two parallel ribs and further having an upper section extending rearwards and upwards to reach over each of said two parallel ribs, each of said two wing pieces further having a concave upper surface extending from a leading edge to a single linear trailing edge thereof and a convex lower surface extending from the leading edge to the single linear trailing edge, said convex lower surface being longer than said concave upper surface, said concave upper surface and said convex lower surface extending substantially the full width of each of said two wing pieces, each of said two wing pieces being wider than a distance between said two parallel ribs and, and said concave upper surface being exerted on by a downward pressure brought about by water current at the time when said water current flows through said concave upper surface and said convex lower surface of said each of said two wing pieces.

2. The motorboat water inlet foil grating according to claim 1 comprising a first reinforcing portion located between an upper edge of each of said two parallel ribs and said convex lower surface of said upper section of leach of said two wing pieces, said first reinforcing portion having an upper surface extending rearwards and downwards from an upper edge of said upper section of each of said two wing pieces to become connected with said upper edge of each of said two parallel ribs.

3. The motorboat water inlet foil grating according to claim 1 comprising a second reinforcing portion located between said upper surface of each of said two parallel ribs and said upper surface of said upper section of each of said two wing pieces, said second reinforcing portion having an upper surface extending forward and downwards from an upper edge of said upper section of each of said two wing pieces to become connected with said upper edge of each of said two parallel ribs.

4. The motorboat water inlet foil grating according to claim 1 wherein each of said two parallel ribs is provided axially with an arcuate projection having a predetermined length and a predetermined width and extending downwards; and wherein a line connecting lower edges of said two wing pieces is coplanar with a bottom of a motorboat hull and is separated by an interval from a lower edge of said arcuate projection.

* * * * *